US009132984B1

(12) United States Patent
King

(10) Patent No.: US 9,132,984 B1
(45) Date of Patent: Sep. 15, 2015

(54) DEVICE FOR LINKING A THREAD SPOOL WITH A MATCHING BOBBIN

(71) Applicant: Blue Feather Products, Inc., Ashland, OR (US)

(72) Inventor: Feather W. King, Ashland, OR (US)

(73) Assignee: Blue Feather Products, Inc., Ashland, OR (US)

( * ) Notice: Subject to any disclaimer, the term of this patent is extended or adjusted under 35 U.S.C. 154(b) by 0 days.

(21) Appl. No.: 14/271,285

(22) Filed: May 6, 2014

(51) Int. Cl.
*D05B 91/16* (2006.01)
*B65H 49/06* (2006.01)
*B65H 75/18* (2006.01)

(52) U.S. Cl.
CPC ..... *B65H 49/06* (2013.01); *D05B 91/16* (2013.01); *B65H 75/185* (2013.01)

(58) Field of Classification Search
CPC ..... D05B 57/26; D05B 43/00; D05B 91/00; D05B 91/14; D05B 91/16; B65H 75/00; B65H 75/02; B65H 75/04; B65H 75/08; B65H 75/14; B65H 75/185; B65H 54/553
USPC ..... 112/186, 231; 206/394, 406; 223/106; 242/118.41, 129.62, 129.7, 130, 136, 242/138, 170, 134
See application file for complete search history.

(56) References Cited

U.S. PATENT DOCUMENTS

| | | | | |
|---|---|---|---|---|
| 462,702 | A | 11/1891 | Haas | |
| 470,328 | A | 3/1892 | Harlow | |
| 1,099,252 | A * | 6/1914 | Kalina | 223/107 |
| 1,405,554 | A | 2/1922 | Northcraft | |
| 1,508,105 | A | 9/1924 | Kamla | |
| D146,869 | S | 6/1947 | Olsen | |
| 2,431,423 | A | 11/1947 | Robbins | |
| 2,944,761 | A | 7/1960 | Best | |
| 3,434,590 | A * | 3/1969 | Laughlin et al. | 223/109 R |
| 3,491,893 | A | 1/1970 | Morris | |
| 3,738,590 | A | 6/1973 | Granati | |
| 3,811,608 | A * | 5/1974 | Olney | 223/106 |
| 3,948,396 | A | 4/1976 | Upton et al. | |
| 4,029,241 | A | 6/1977 | Krake | |
| 4,094,415 | A | 6/1978 | Larson | |
| 4,155,519 | A * | 5/1979 | Price | 242/118.41 |
| 4,195,739 | A | 4/1980 | Sweet, III | |
| 4,351,458 | A | 9/1982 | Wolfe | |
| 4,824,041 | A * | 4/1989 | Myers | 242/118.41 |
| 4,972,979 | A * | 11/1990 | Gordon | 223/99 |
| 5,727,699 | A | 3/1998 | Gilcrease | |
| 5,913,485 | A | 6/1999 | Bruffett | |
| 6,170,416 | B1 * | 1/2001 | Gulsby | 112/279 |
| 6,789,771 | B1 | 9/2004 | Shick et al. | |
| 7,100,856 | B2 * | 9/2006 | Murphy, Jr. | 242/118.41 |
| 7,992,819 | B2 | 8/2011 | King | |
| 8,286,905 | B1 | 10/2012 | King | |

* cited by examiner

*Primary Examiner* — Ismael Izaguirre
(74) *Attorney, Agent, or Firm* — Thomas M. Freiburger

(57) ABSTRACT

A device links thread spools with matching bobbins, using a rubber band. A cap or head extends down through a center bobbin hole and has a hook at its lower end. The rubber band is connected to this hook and extended down through the center hole of a thread spool. The rubber band is then spread open, stretched around the spool and over the top of the bobbin, and slipped into a groove at the top of the cap or head, thereby retaining the bobbin against the top of the spool. Provision is included for curtailing the length of the band when needed for a shorter spool. This can be a bead slidable on the rubber band, or multiple parallel grooves on the top of the cap, to take up some of the length of the band.

6 Claims, 3 Drawing Sheets

DEVICE FOR LINKING A THREAD SPOOL WITH A MATCHING BOBBIN

BACKGROUND OF THE INVENTION

This invention concerns sewing equipment and supplies, and especially directed to a versatile device that is used to join bobbins of differing sizes with thread spools and cones of greatly varying sizes.

Seamstress work, using one or more sewing machines, requires a collection of spools of different thread, as well as bobbins for the various spools, often holding thread particular to a spool. The spools and bobbins are often switched frequently on a sewing machine.

Quite a number of devices have been conceived to accommodate multiple spools and/or bobbins for retrieval and storage in sewing. These come in a wide variety of forms. See, for example, U.S. Pat. Nos. 5,913,485, 5,727,699, 4,351,458, 4,195,739, 4,029,241, 3,948,396, 3,738,590, 2,944,761, 1,508,105, 1,405,554, 470,328, 462,702 and Des. 146,869. See also U.S. Pat. Nos. 6,789,771, 4,094,415, 3,491,893 and 2,431,423 showing devices for holding other articles not related to sewing.

In addition, U.S. Pat. Nos. 7,992,819 and 8,286,905, both developed by the inventor herein, describe a thread spool and bobbin holder wherein a series of flexible spindles can hold thread spools, optionally including a bobbin on the spindle, and the spindles are retained in a holder that receives a base end of each spindle in a sliding action.

The current invention is designed particularly for storing a bobbin with a corresponding thread spool, with the two secured together, and with versatility to accommodate thread spools and cones of widely varying sizes.

There is a need for a convenient, compact and versatile spool holder, preferably also for bobbins, to keep these items together and readily available for storage and retrieval.

SUMMARY OF THE INVENTION

The device of the invention in a preferred embodiment utilizes a rubber band (elastic band), a slide piece or bead secured to the rubber band, and a bobbin-engaging cap or head to secure a bobbin to a thread spool or cone, the device having an adjustment feature to accommodate bobbins of different sizes and spools and cones of very different sizes.

The invention achieves this object in general by use of the slide piece or bead captured onto the rubber band, with each of two parallel sections of the rubber band positioned within the bead, such that the bead can slide along the rubber band. The bead can be located in either of two different general positions relative to the thread spool and the bobbin, so as to take up some of the length of the rubber band in one position, to accommodate a thread spool which is short in height. In either position of the bead, the rubber band when installed secures a bobbin firmly to the top end of a corresponding thread spool. Other arrangements are possible for taking up some of the rubber band when needed.

The invention provides a versatile and efficient bobbin holder to maintain a bobbin with the appropriate spool of thread. These and other objects, advantages and features of the invention will be apparent from the following description of a preferred embodiment, considered along with the accompanying drawings.

DESCRIPTION OF PREFERRED EMBODIMENTS

Figure 2:
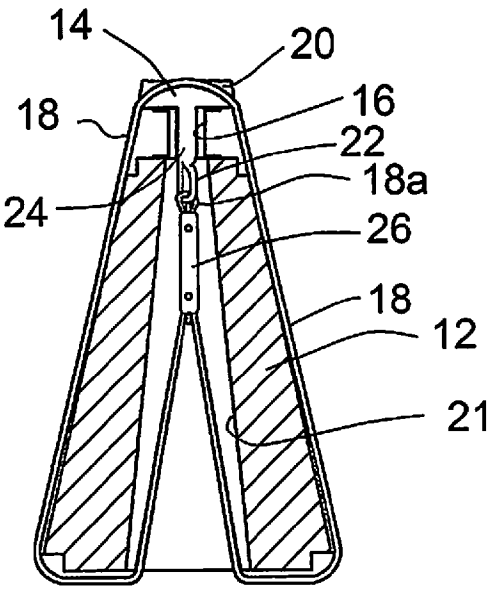
FIG. 2 is a cross section in elevation, as seen along the line 2-2 in FIG. 1.
Figure 1:
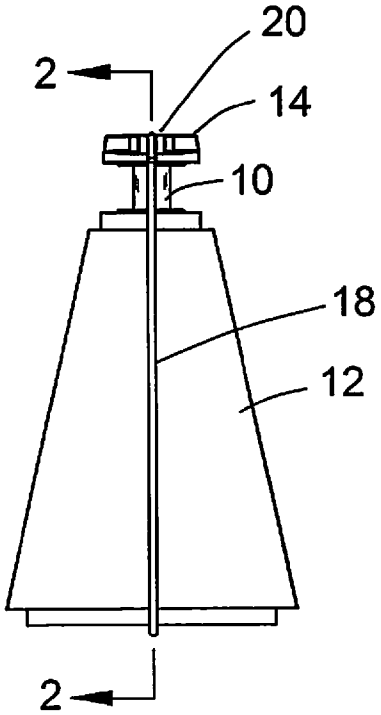
FIG. 1 is an elevation view showing the device of the invention retaining a bobbin and thread cone together.
Figure 3:
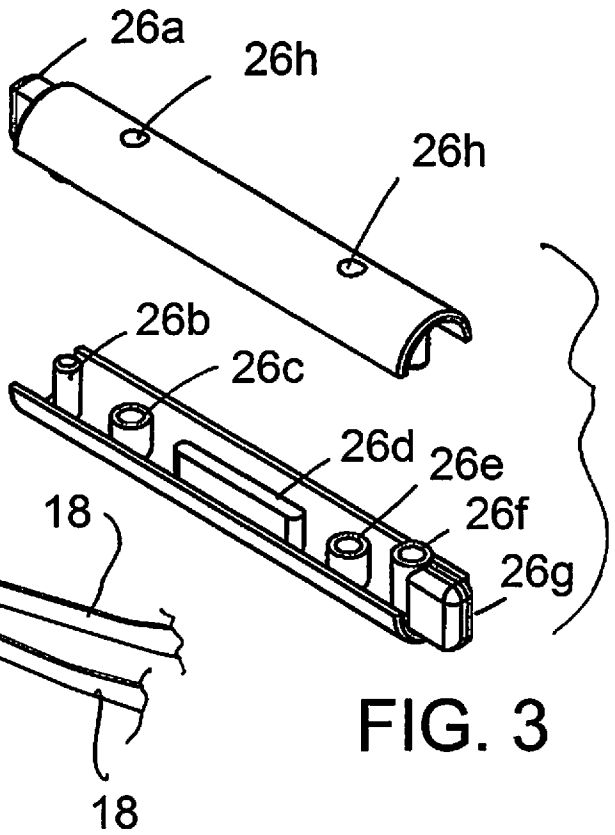
FIG. 3 is an exploded perspective view showing a slide piece or bead to be secured onto a rubber band as a component of the invention.
Figure 4:
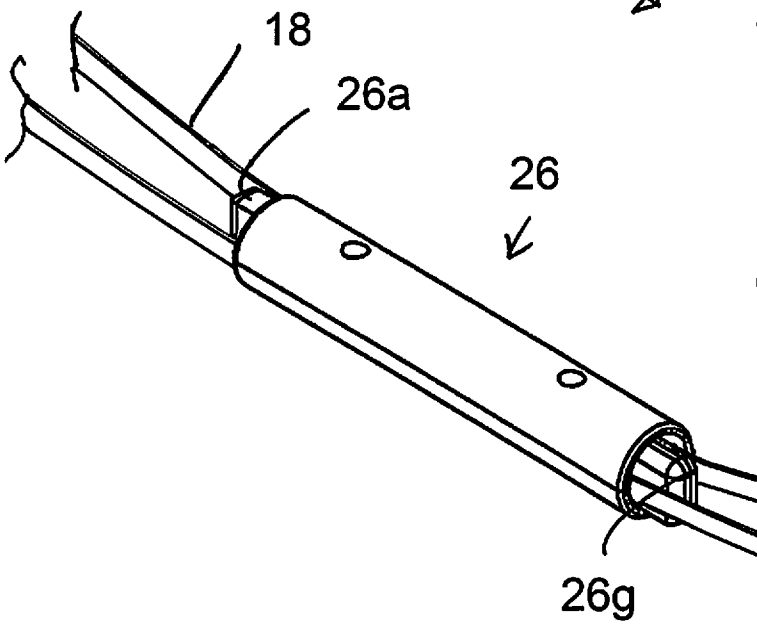
FIG. 4 is a perspective view showing the slide piece of FIG. 3 assembled together onto a rubber band.

The invention is a device which acts as a connector for any size spool or cone of thread and any machine bobbin having a central hole containing matching thread, i.e. a companion bobbin to the thread spool. FIG. 1 shows the invention in use, retaining a bobbin 10 to a thread cone 12, the thread cone being rather tall in height as compared to a typical thread spool. A cap or head 14 extends down into and engages the bobbin 10, via a central hole 16 in the bobbin as shown in FIG. 2, and a rubber band (that term including natural rubber or synthetic latex rubber bands) 18 extends over the top of the cap 14, in a groove 20, and around both sides of the thread cone 12. The sectional view of FIG. 2 shows that the rubber band or elastic band 18, wrapping around the bottom of the thread cone, extends up into the center bore 21 (which may be tapered, as shown) of the thread cone and has an end 18*a* connected over a depending hook 22 that is formed on a stem 24 of the cap 14, extending down from a head 25 of the cap. A slide piece or bead 26 is secured on the rubber band so as to contain two parallel portions of the rubber band and is shown in FIGS. 3 and 4. The cap 14, with its stem 24 and hook 22, is shown in FIGS. 6 and 7.

The slide piece 26 is slidable along the rubber band, and is shown in FIG. 2 in a typical position when the device of the invention is secured on a thread spool or cone of relatively long length (height). One function of the slide piece or bead 26 is to make easy the insertion of the rubber band down through the bobbin and the thread spool center bore 21.

The channel or groove 20 in the top surface of the cap 14 holds the rubber band stably in position, as shown in FIGS. 1 and 2.

Figure 6:
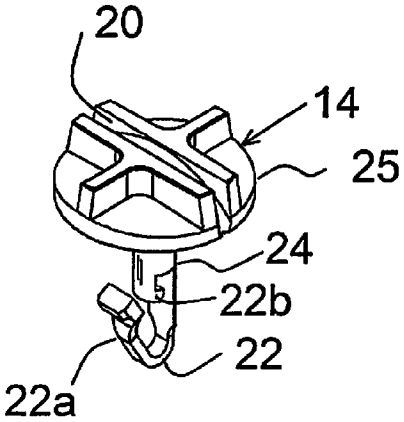
FIG. 6 is a perspective view showing a cap of the device, with a depending closeable hook.
Figure 7:
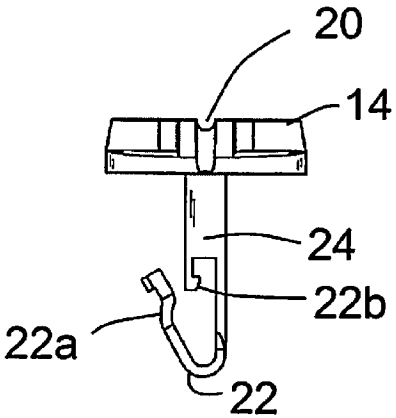
FIG. 7 is a side elevation view of the cap shown in FIG. 6.

As shown in FIGS. 6 and 7, the cap 14's hook 22 has an opening and closing safety-pin type mechanism in this preferred embodiment. When the open leg 22*a* of the hook is locked into a corresponding hook or tab 22*b* formed on the stem 24 opposite the hook leg 22*a*, a loop is created from which an attached band is secure and will not escape. This stem/hook structure 24/22 is to be inserted down into the central hole of a bobbin.

The rubber band, preferably a synthetic latex, can be about 3.5 inches in length when collapsed (doubled), i.e. a total perimeter of about 7 inches, with a width of about ⅛ inch and a thickness of about 0.032 inch. These dimensions can vary, especially the width and thickness. The length can vary about 10% to 20% either way.

The plastic bead or slide piece 26 fastens around the rubber band in such a way as to keep the two parallel sides or portions of the rubber band separate. The bead can move up and down along the length on the rubber band, with each side of the band passing in its own channel within the bead. The channel structure is indicated in FIGS. 3 and 4. Certain internal elements of the bead 26 divide the interior of the preferably cylindrical bead into two parallel channels, these elements being shown at 26*a*, 26*b*, 26*c*, 26*d*, 26*e*, 26*f* and 26*g* in FIGS. 3 and 4. The two halves of the bead preferably are identical, and when the two portions as shown in FIG. 3 are assembled together as in FIG. 4, which may be by friction retention, the elements 26*b* mate into the elements 26*f*, at both ends. Holes 26*h* are to aid in the assembly process with a rubber band. The elements 26*c* and 26*e* are located at these holes and give additional rigidity for the assembled bead. Thus, the assembled bead cylinder is formed, divided into two channels for the rubber band, which is shown in FIG. 4. This construction enables sliding of the bead up and down along the rubber band 18.

Figure 5:
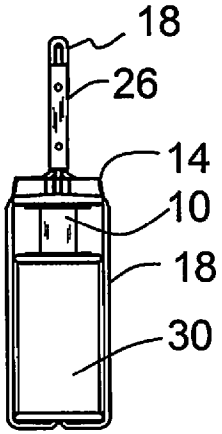
FIG. 5 is an elevation view showing a bobbin retained on a short length thread spool by the device of the invention.

At the two ends of the bead, end elements 26*a* and 26*g* extend out from the cylinder for a particular purpose. They act as divider protrusions to force the looping-over of the band 18 to occur outside the internal cavity of the bead, to enable grasping of the band by itself when the bead is to be moved by sliding along the band. FIG. 5 shows the band looping over one of these protruding bead elements.

To secure a bobbin to a thread spool or cone as in FIGS. 1 and 2, the rubber band 18 with the bead positioned at the farthest point downward is passed through the center of a bobbin 10, and with the upper end of the rubber band secured to the hook 22 of the cap, it is passed through the center of a spool or cone of thread. In this procedure the bead 26 helps put the rubber band through the bobbin and spool. In the case of a short thread spool 30 as in FIG. 5, the bead remains at the lower end of the rubber band and is grasped and pulled down and then up and over the head or cap 14. As this is done the two sides of the rubber band are spread apart and stretched up each respective side of the thread spool. With the rubber band stretched up over the cap 14, it is dropped into the groove or channel, traversing the cap 14.

For this situation of a short thread spool 30 as in FIG. 5, the bead or slide piece 26 has been maintained at the extreme end of the rubber band remote from the hook 22, which was the lowermost point but which, after installation, is at the top of the cap 14. The bead 26 sits upright atop the bobbin and spool as shown in FIG. 5, taking up slack in the length of the rubber band in this case of a shorter spool. The curtailed length of the rubber band secures the bobbin and spool together.

When the spool or cone of thread is medium or taller in height, as in FIGS. 1 and 2, the bead 26 on the rubber band remains at the bottom of the length of the rubber band, farthest away from the head or cap 14 and the hook 22 to which the rubber band is connected, while feeding the band down through the central bobbin hole and the thread spool core or cone center 21. When the bead 26 has passed entirely down through the center hole of the thread spool, or just at the bottom of the inside tapered chamber of the thread cone, it is grasped and pulled out enough to slide the bead up along the rubber band, inside the cone or tall spool. With the bead 26 inside the center of the spool or cone (it can be pushed completely up as in FIG. 2, or somewhat lower but still within the spool or cone), the rubber band sides are separated and then stretched up each side of the large spool or cone 12 and over the cap 14 and into the groove 20, as shown in FIGS. 1 and 2.

For both the short spool and the tall spool, the cap or head 14 can first be placed into the bobbin hole, followed by attachment of the elastic band 18 onto the hook 22 extending somewhat below the bobbin. The above description refers to attaching the band 18 first, then extending it down through the bobbin hole. Either procedure can be used, and no limitation is implied as to order of these steps, herein or in the claims, which are intended to read on either procedure.

The device of the invention is thus highly adaptable and uniquely capable of joining bobbins of different sizes with thread spools and cones of greatly varying sizes.

Broadly speaking the invention encompasses a thread spool and bobbin linking device having a cap for engaging with the bobbin, connectable to a rubber band that passes down through the bobbin and thread spool, and such that the rubber band can be drawn up from the bottom of the spool and wrapped around the outside of the spool and secured over the top of the cap, and with some provision for curtailing the effective length of the rubber band when needed, to accommodate smaller spools, particularly of shorter height.

Figure 8:
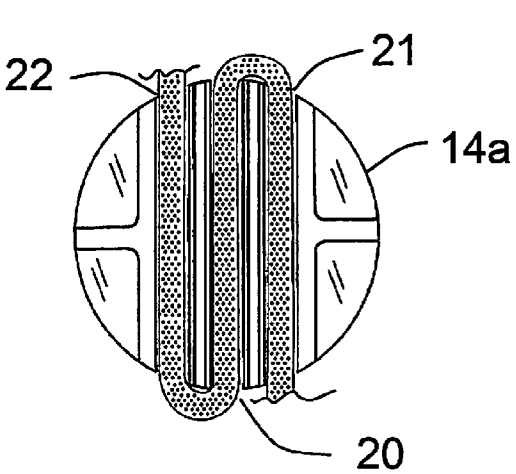
FIG. 8 is a plan view showing an alternative regarding one feature of the invention.

FIG. 8 shows an alternative method and structure for curtailing the length of the elastic band when this is needed for a short spool. This is an alternative to the bead or slide piece 26.

A modified cap 14*a* has three parallel grooves or channels 20, 21 and 22, rather than simply the central groove 20 shown in FIGS. 6-7 and other drawings. The procedure for a tall spool or cone is similar to that described above, but without the bead. Only the center groove or channel 20 on the top of the cap 14*a* is used, and the bobbin is retained on the tall spool as shown in FIG. 1. The disadvantage here is that the rubber band is somewhat more difficult to put through the spool, without the bead being present.

When a shorter spool is involved, the same procedure is used except that, after the rubber band is laid in the center groove 20 of the cap, can then be wound around in serpentine fashion as shown in FIG. 8, into the side take-up grooves 21 and 22, taking up length of the rubber band to provide a curtailed effective length for use on the short spool, with the assembly then appearing as in FIG. 5 but without the bead 26. More preferably, the user can first lay the rubber band in one of the side grooves (21, 22) and then wind it through the center groove and the other side groove.

It is also possible to include both the cap 14*a* of FIG. 8 and the bead on the rubber band, thus applying to a situation where three greatly different heights of spools will be encountered.

The term "spool" or "thread spool" as used in the claims is intended to include a cone as well as a spool.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An apparatus for retaining a sewing machine bobbin to a thread spool, comprising:

a cap having a head portion adapted to be engaged against the top of a bobbin, the cap including a stem depending from the head portion, the stem terminating in a bottom hook, with the stem sufficiently small in width to pass down into a center hole on a bobbin, an elastic band which can be engaged into the hook of the cap by looping the elastic band in the hook, the head portion of the cap having a groove at an upper side, the groove being essentially linear and extending across the head, sized to receive the elastic band in the groove, and means for selectively curtailing the effective length of the elastic band when desired, for a thread spool of short height, whereby the apparatus can be used to retain a bobbin on a spool by passing the stem of the cap down through the center hole of a bobbin, attaching the elastic band onto the hook of the cap, extending the elastic band down through the center hole of a spool, grasping a lower end of the elastic band and pulling it out from the bottom of the spool, spreading the elastic band around the sides of the spool and up and over the top of the cap above the bobbin, and placing the elastic band in the groove of the cap.

2. Apparatus according to claim 1, wherein the means for curtailing the effective length of the elastic band comprises a slidable bead secured on the elastic band such that two parallel portions of the elastic band pass through the bead and the bead being slidable along the elastic band, whereby, for a spool of greater height the bead will assist in placing the elastic band down through the center hole of the spool and the bead can reside within the center hole of the spool with the elastic band secured to the hook, and the elastic band being used in essentially its full length when stretched to retain the bobbin on the spool, and for a spool of lesser height the bead can be moved to an end of the elastic band opposite the stem and hook, so that when the band is stretched around the top of the bobbin and over the cap, the bead is positioned on the elastic band to extend above the cap, taking up a portion of the length of the elastic band so as to accommodate a shorter spool.

3. Apparatus according to claim 2, wherein the bead is essentially cylindrical and formed of two identical plastic halves secured together.

4. Apparatus according to claim 2, wherein the bead includes divider protrusions extending out both ends of the bead so that when the elastic band loops over a divider protrusion the band is graspable to enable sliding of the bead along the band.

5. Apparatus according to claim 1, wherein the means for curtailing the effective length of the elastic band, for a short thread spool, includes two side take-up grooves on the cap, both parallel to said groove and on either side of said groove, so that the elastic band when placed on the top of the cap can be wound through all three grooves to take up a portion of the band's length.

6. Apparatus according to claim 1, wherein the hook on the stem is openable and closeable, with a flexible open leg which can be closed and locked against a corresponding tab formed on the stem to capture an elastic band assembled onto the hook.

* * * * *